US006899585B2

(12) United States Patent
Nelson

(10) Patent No.: US 6,899,585 B2
(45) Date of Patent: May 31, 2005

(54) BODY SUSPENDED NOVELTY MUSIC SYSTEM

(76) Inventor: Webb T. Nelson, 19180 144th Avenue, NE., Woodinville, WA (US) 98072

( * ) Notice: Subject to any disclaimer, the term of this patent is extended or adjusted under 35 U.S.C. 154(b) by 0 days.

(21) Appl. No.: 10/261,203

(22) Filed: Oct. 1, 2002

(65) Prior Publication Data

US 2004/0063378 A1 Apr. 1, 2004

(51) Int. Cl.[7] ..... A63H 33/00

(52) U.S. Cl. ..... 446/26; 446/397; 446/404; 446/71; 84/800; 455/575

(58) Field of Search ..... 84/600–602, 609–611, 84/649–651, 723–725, 730, 453, 477 R, DIG. 24; 2/209.13; 351/158; 446/404, 397, 71, 26, 27, 28; 455/75.6, 575

(56) References Cited

U.S. PATENT DOCUMENTS

| | | | | | |
|---|---|---|---|---|---|
| 3,186,124 | A | | 6/1965 | Voss | 46/51 |
| 3,254,444 | A | | 6/1966 | Paterson | 46/228 |
| D207,919 | S | * | 6/1967 | Fai | D16/309 |
| 3,342,482 | A | | 9/1967 | Paolone | 272/57 |
| 4,221,074 | A | | 9/1980 | Gonzalez | 446/28 |
| 4,257,062 | A | * | 3/1981 | Meredith | 84/464 R |
| 4,882,769 | A | * | 11/1989 | Gallimore | 455/344 |
| 4,905,560 | A | * | 3/1990 | Suzuki et al. | 84/600 |
| 5,127,301 | A | * | 7/1992 | Suzuki et al. | 84/600 |
| 5,147,969 | A | * | 9/1992 | Hiyoshi et al. | 84/600 |
| 5,606,743 | A | * | 2/1997 | Vogt et al. | 455/347 |
| 5,921,890 | A | * | 7/1999 | Miley | 482/3 |
| 6,220,917 | B1 | | 4/2001 | Nelson | 446/27 |

FOREIGN PATENT DOCUMENTS

| | | | | | |
|---|---|---|---|---|---|
| JP | 59154422 | A | * | 9/1984 | G02C/11/00 |
| JP | 03018302 | A | * | 1/1991 | A43B/23/24 |
| JP | 03288897 | A | * | 12/1991 | G10H/1/34 |
| WO | WO 9601073 | A1 | * | 1/1996 | A47L/13/38 |

* cited by examiner

*Primary Examiner*—Derris H. Banks
*Assistant Examiner*—Urszula M Cegielnik
(74) *Attorney, Agent, or Firm*—Lamorte & Associates

(57) ABSTRACT

An amusement device that includes a mounting assembly that is selectively attachable to a person's body. An electronic assembly is either built into, or attached to, the mounting assembly. The electronic assembly includes a sensor that detects movement. Also included in the electronic assembly is a sound generating device that generates one note of a melody each time the sensor detects movement. By manipulating the mounting assembly on the body, a user can repeatedly trigger the sensor and cause sound generating assembly to produce notes.

15 Claims, 4 Drawing Sheets

BODY SUSPENDED NOVELTY MUSIC SYSTEM

BACKGROUND OF THE INVENTION

1. Field of the Invention

In general, the present invention relates to amusement devices that challenge a person's physical coordination and sense of timing. More particularly, the present invention is related to musical devices that attach to the body and are played using selective manipulations of the body.

2. Description of the Prior Art

When a person grasps or manipulates another object, it is most often done with the hands. As such, it is a physiological necessity that people develop good hand/eye coordination and dexterity. The degree of coordination of the hands and arms is usually vastly superior to that of any other major muscle group in the body.

Since physical coordination of muscle groups other than the hands and arms is typically underdeveloped, it can be somewhat amusing to attempt to complete otherwise simple tasks using these other muscle groups. It is also amusing to watch a person attempt to complete simple tasks using a muscle group other than those contained in the arms and hands. It is for these reasons that the prior art is replete with amusement devices that attach to the body at different points and provide simple tests of coordination and timing. The most famous of such prior art devices is the Hula Hoop, which is spun around the waist. Other prior art amusement devices that attach to the waist and test coordination are exemplified by U.S. Pat. No. 3,186,124 to Voss, entitled Peg And Hoop Exercising Toy; U.S. Pat. No. 3,342,482 to Paclone, entitled Waist Mounted Gyration Rod Recreational Device; U.S. Pat. No. 3,610,622, entitled, Hip-Toss Ball Game; and U.S. Pat. No. 3,224,774 to Klotz, entitled Ball And Paddle Device.

In addition to the waist, amusement devices have been developed that attach to the head and legs. Prior art amusement devices that are worn on the leg are exemplified by U.S. Pat. No. 3,165,315 to Petrusek, entitled Skipping Device and U.S. Pat. No. 5,603,651 to Shure, entitled Bubble-Producing Skipping Toy.

Prior art amusement devices that are worn on the head are exemplified by U.S. Pat. No. 6,220,917 to Nelson, entitled Body Suspended Amusement Device.

Typically, when an amusement device first is attached to the body, a person can slowly manipulate the amusement device. The amusement device can then typically only be rapidly manipulated after several practice sessions. The practice sessions are required to develop the muscle coordination needed to control the amusement device. If a person tries to manipulate the amusement device quicker than he/she can control, then the attempt fails.

The present invention device is an amusement device that attaches to the body. The amusement device plays music depending upon controlled movements of the body. Music has a specific beat. As such, in order to play a piece of music a person is required not: only to manipulate their body, but to do so in beat with the music. This task provides play value to the present invention device that does not exist in other body attached novelty devices.

SUMMARY OF THE INVENTION

The present invention is an amusement device. The amusement device includes a sensor that detects movement.

The sensor is coupled to a sound generating assembly. The sound generating assembly plays one note of a selected melody each time the sensor detects movement.

A body supported object is provided that attaches to a person's body. The sensor and the sound generating assembly are attached to the body supported object. Accordingly, in order to cause the sensor to detect movement and cause the sound generating assembly to play, a person must move the part of their body onto which the body supported object is attached. Since the sound generating assembly only plays one note of a melody each time movement is detected, a person must move their body in beat with the melody in order to cause the melody to play properly. The repeated sporadic movements of the body needed to cause the selected melody to play properly provides novelty to the person wearing the present invention as well as to others who are watching the person wearing the present invention.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Figure 1:
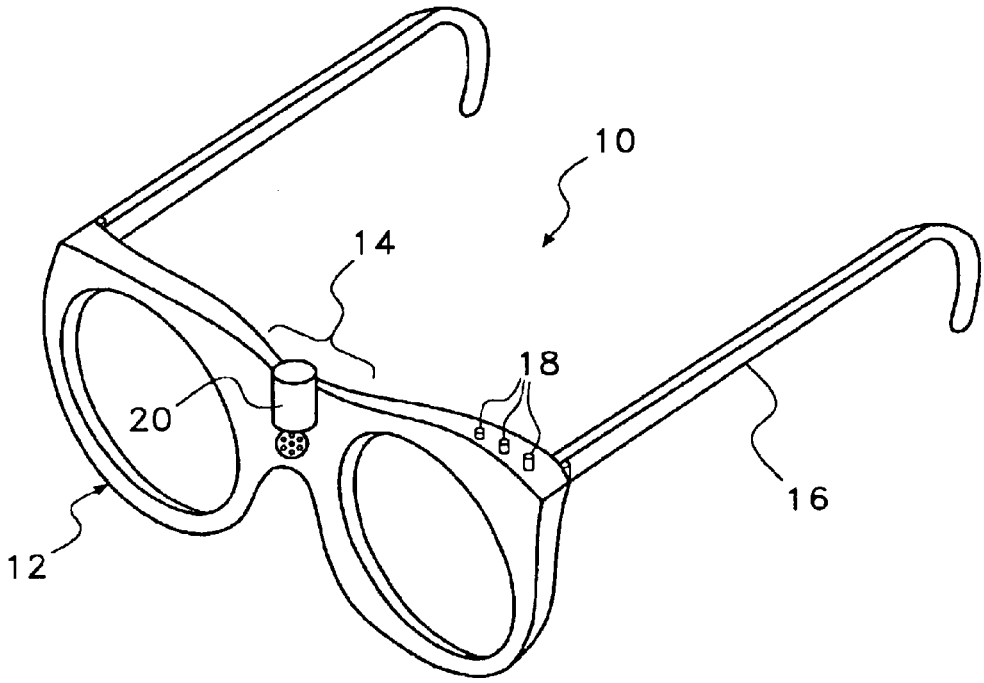
FIG. 1 is a perspective view of an exemplary embodiment of the present invention.

Referring to FIG. 1, there is shown an exemplary embodiment of an amusement system 10 in accordance with the present invention. The amusement system 10 includes a pair of eyeglass frames 12. The eyeglass frames 12 contain a bridge region 14 that extends across the top of the nose and two temple elements 16 that extend over the ears. As will later be described, electronic circuitry is contained within the eyeglass frames 12. Control buttons are present on the eyeglass frames 12 so that the electronic circuitry can be activated and preset for operation.

A tilt sensor 20 is attached to the eyeglass frames 12. In the embodiment of FIG. 1, the tilt sensor 20 is positioned in front of the bridge 14 of the eyeglass frames 12. The tilt sensor 20 can detect when the eyeglass frames 12 are moved in any direction.

The electronic assembly within the eyeglass frames 12 contains a tone generator that is preprogrammed with a plurality of different well-known song melodies. The song melody can be selected using the control buttons 18 on the eyeglass frames 12. The tone generator only generates a single tone from a selected melody each time the tilt sensor 14 is activated. Accordingly, in order to cause the tone generator to generate the tones of the selected melody, a person must move the eyeglass frames 14 back and forth. In order to keep the selected melody in its proper beat, the eyeglass frames 12 must be moved to the beat of the melody. As a result, a person wearing the eyeglass frames 12 must make timed coordinated head movements in order for the tone generator in the eyeglass frames 12 to properly produce the selected melody.

Figure 2:
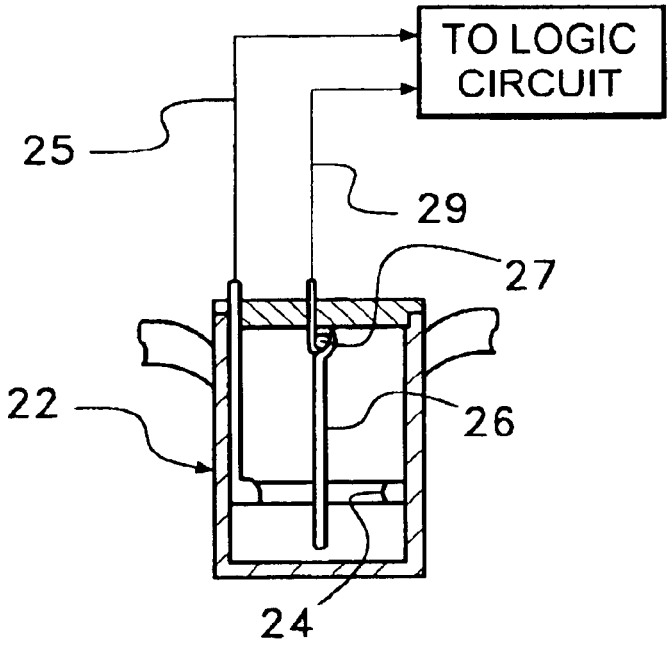
FIG. 2 is a cross-sectional view of an exemplary embodiment of a motion sensor used as part of the present invention.

Referring to FIG. 2, a cross section of an exemplary embodiment of the tilt sensor 20 is shown. In this embodiment, the tilt sensor 20 includes a hollow tubular structure 22. Inside the tubular structure 22 is an annular contact 24. The annular contact 20 is electrically interconnected to a first lead 25 that extends from the tilt sensor 20.

An elongated contact arm 26 is suspended in the center of the tubular structure 22. The elongated contact arm is electrically interconnected to a second lead 29 that extends from the tilt switch. The contact arm 26 is free to rotate in any direction about its point of suspension 27. Accordingly, when the tubular structure 22 of the tilt switch 20 is accelerated or tilted in any direction, the elongated contact arm 26 swings freely inside the tubular structure 22. If the tubular structure 22 is tilted or if it is moved with enough acceleration, the elongated contact arm 26 will touch the annular contact 24 inside the tubular structure 22.

Both the elongated contact arm 26 and the annular contact 24 are attached to a logic circuit. Each time the elongated contact arm 26 touches the annular contact 24, an electrical connection is completed. Conversely, every time the elongated contact arm 26 moves away from the annular contact 24, the electrical connection is broken. Accordingly, the tilt sensor 20 operates between two states. In one state, an electrical connection is made, and in the other state, an electrical connection is broken. Since the tilt sensor 20 operates in only two states, it can be used in a digital circuit, wherein the tilt sensor 20 creates a pulsed signal over time containing varying pulse changes between an "on" condition when the electrical connection is made, and an "off" condition when the electrical connection is broken.

Figure 3:
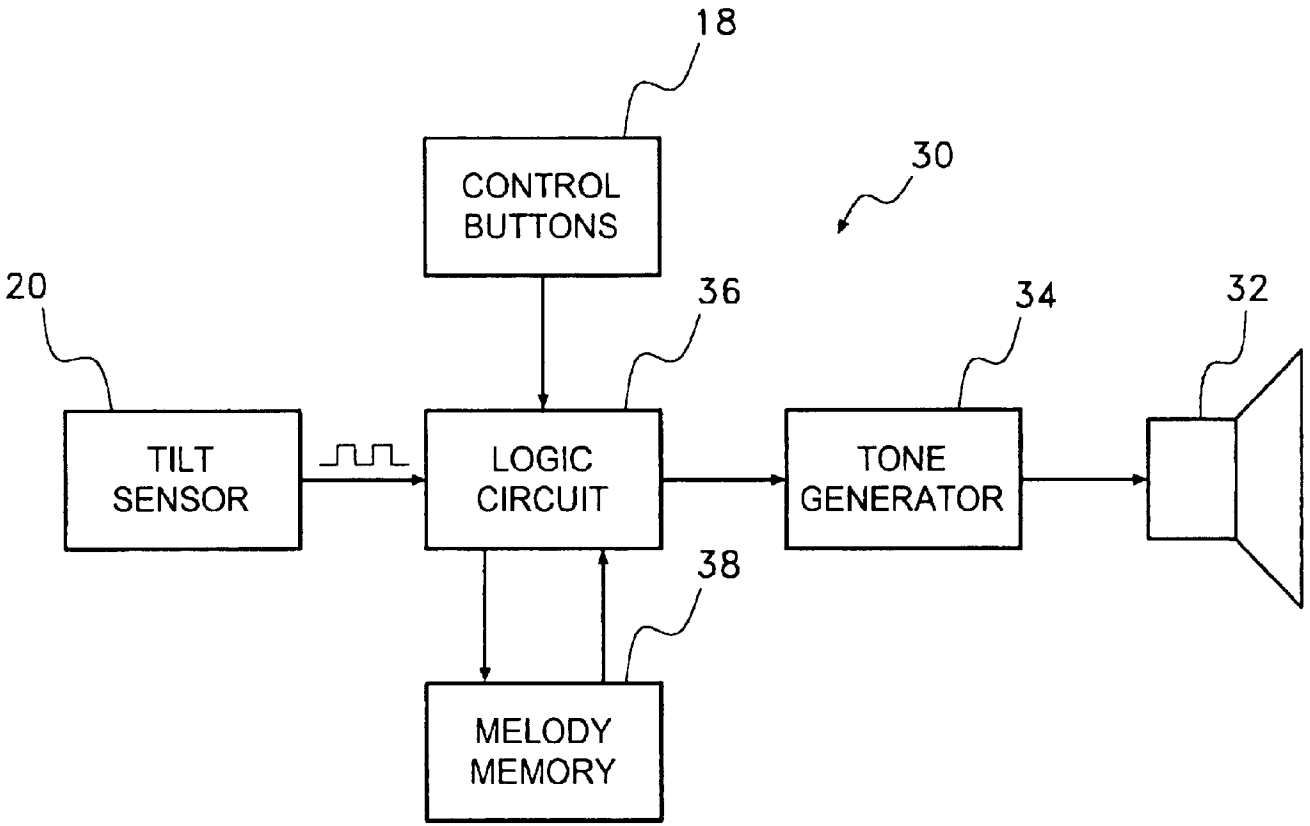
FIG. 3 is a schematic block diagram illustrating the electronic components of the present invention.

Referring to FIG. 3, it can be understood that contained within the eyeglass frames 12 (FIG. 1) is an electronic assembly 30. The electronic assembly 30 contains a speaker 32 and a tone generator 34 that produces various tones for the speaker 32. The tone generator 34 is directed by a logic circuit 36, wherein the logic circuit 36 is used to select a melody from a plurality of preprogrammed melodies that are stored in a memory 38. The selection of different melodies from the memory 38 can be performed by a user, utilizing the button controls 18.

Once a melody is selected, the logic circuit 36 only sends the tones of that melody to the tone generator 34 one note at a time. The only time that the logic circuit 36 sends a note to the tone generator 34 is when the logic circuit 36 detects a change in state from the tilt sensor 20. Accordingly, each time the tilt sensor 20 changes between an "on" state and an "off" state, the logic circuit 36 sends a single note from the selected melody to the tone generator 34. The tone generator 34 then produces the tone that is broadcast through the speaker 32. As such, if a person wants the melody being played to sound proper, that person must move the tilt sensor 20 to the beat of the selected melody. Since the tilt sensor 20 is connected to eyeglass frames 12 (FIG. 1), the person wearing the eyeglass frames must repeatedly move their head to the beat of the melody in order to change the state of the tilt sensor 20 to the beat of that melody. This causes a person to rapidly move their head in a sporadic manner that is fun for both the person wearing the eyeglass frames and other people who are watching.

Referring back to FIG. 1, the tilt sensor 20 is attached to the bridge of the eyeglass frames and the electronic assembly of FIG. 3 is contained within the structure of the eyeglass frames. Such a structure is merely exemplary, and it should be understood that the tilt switch and the electronics of the present invention can be located in many different positions on the eyeglass frame or may even be embodied in an assembly that can be retroactively attached to a separate pair of eyeglasses or other body supported object.

Figure 4:
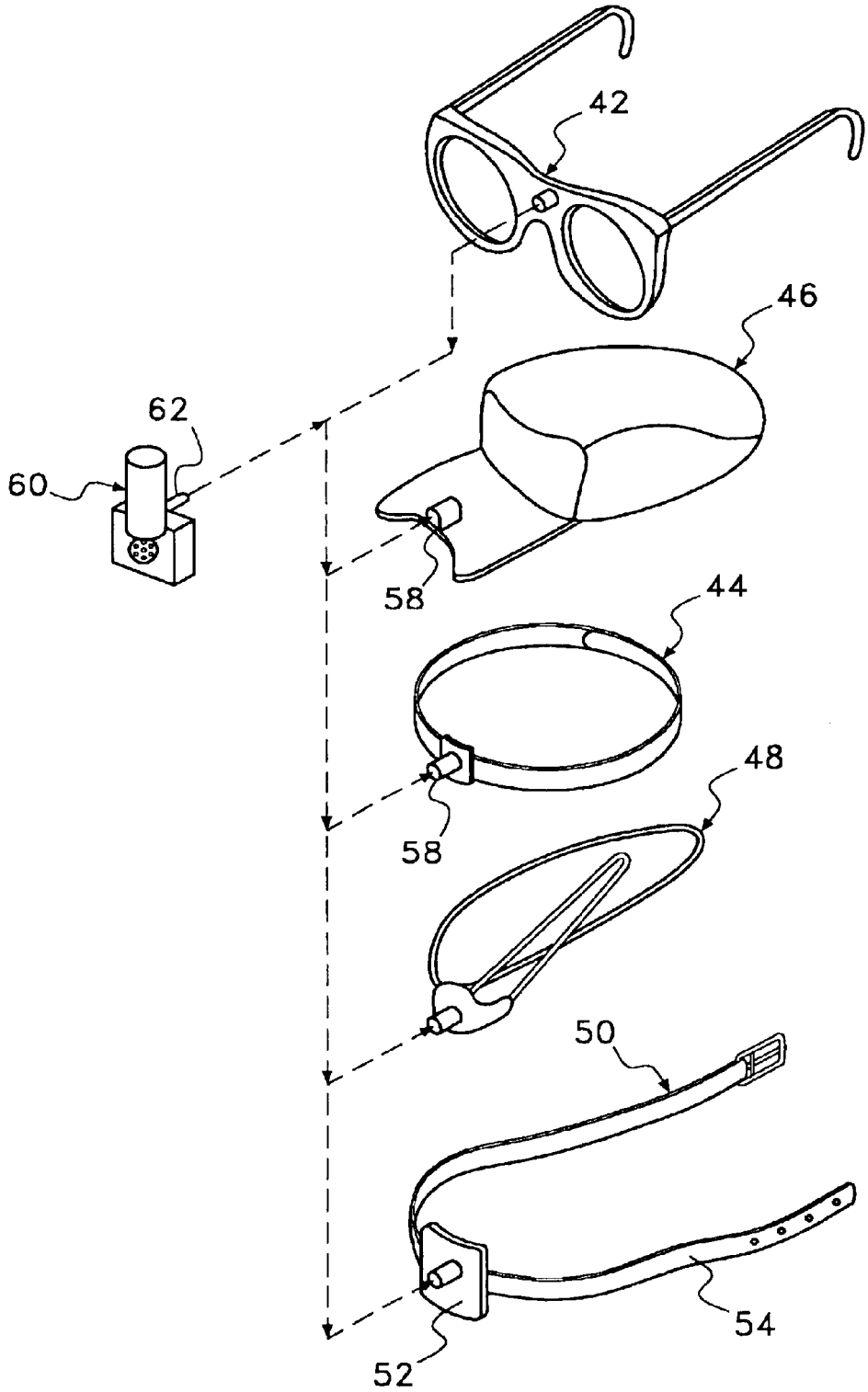
FIG. 4 is a perspective view of an alternate embodiment of the present invention having multiple body mounting options.

Referring to FIG. 4, such an alternate embodiment of the present invention device is shown. In FIG. 4, a plurality of body supported objects 40 are shown that can be used to attach the present invention to a person's body. The body supported objects include a pair of eyeglass frames 42. Also shown are other body supported objects that can be substituted for the eyeglass frames 42. Among the substitutes include a head band 44 that can be worn around the head, a hat 46 that can be worn on the head, a chin strap 48 that is worn on the chin, and a body strap assembly 50. The body strap assembly 50 includes a mounting plate 52. The mounting plate 52 is connected to a strap 54. The strap 54 can be secured around the waist, arm, leg or any other part of the body.

An electronic assembly 60 is provided that can be attached to any of the body supported objects 40. The electronic assembly 60 includes the electronic components described in FIG. 3 along with a battery for power. Accordingly, the electronic assembly 60 plays one note of a selected melody each time the electronic assembly 60 is accelerated or jarred. The electronic assembly 60 can attach to any of the body supported objects using a mechanical fastening system, such as a hook, or other fastening systems such as Velcro. In the shown embodiment, each of the body supported objects 40 has a female connector 58. The electronic assembly 60 contains a small male protrusion 62 that passes into any of the female connectors 58 and engages the female connectors 56 with a friction fit. Accordingly, the electronic assembly 60 can be attached to any of the body supported objects 40 by simply pressing the male protrusion 62 of the electronic assembly 60 into the female connector 58 of a body supported object 40.

It will be understood that the embodiments of the present invention amusement system that are described and illustrated herein are merely exemplary and a person skilled in the art can make many variations to the embodiment shown without departing from the scope of the present invention. For example, there are many types of sensors that can detect physical movement. Such sensors include accelerometers, mercury switches, ball hearing switches and the like. Any such sensor can be adapted for use as part of the present invention. All such variations, modifications and alternate embodiments are intended to be included within the scope of the present invention as defined by the appended claims.

What is claimed is:

1. An amusement device, comprising:

a sensor that detects movement;

a sound generating assembly for generating a progression of notes contained within a specific melody, wherein said sound generating assembly is controlled by said sensor and generates only one note from said progression of notes each time said sensor detects movement; and eyeglass frames, wherein said sensor and said sound generating assembly are supported by said eyeglass frames.

2. The device according to claim 1, further including a plurality of melodies stored in a memory and an interface to select a melody from said memory, wherein said sound generating assembly generates a note from said progression of notes of the selected melody each time said sensor detects movement.

3. The device according to claim 1, wherein said sensor moves between an activated state and a deactivated state when said sensor detects movement, wherein said sound generating assembly produces a single note from said progression of notes each time said sensor changes between said activated state and said deactivated state.

4. The device according to claim 1, wherein said sensor and said sound generating assembly are contained within a common electronic assembly.

5. The device according to claim 4, wherein said electronic assembly is selectively attachable and detachable to said eyeglass frames.

6. The device according to claim 1, wherein said eyeglass frames have a bridge.

7. The device according to claim 6, wherein said sensor is attached to said bridge of said eyeglass frames.

8. An amusement device, comprising:

a set of eyeglass frames;

a sensor for detecting when said eyeglass frames are moved;

a sound generating assembly, coupled to said sensor, that produces a subsequent note from a progression of notes contained within a melody each time said sensor detects movement of said eyeglass frames.

9. The device according to claim 8, wherein said sensor and said sound generating assembly are supported by said eyeglass frames.

10. The device according to claim 8, further including at least one control button on said eyeglass frames for selecting a melody to be played by said sound generating assembly from a plurality of possible melodies.

11. The device according to claim 8, wherein said sensor moves between an activated state and a deactivated state when said sensor detects movement, wherein said sound generating assembly produces said subsequent note from said progression of notes each time said sensor changes between said activated state and said deactivated state.

12. The device according to claim 8, wherein said sensor and said sound generating assembly are contained within a common electronic assembly.

13. The device according to claim 8, wherein said electronic assembly is selectively attachable and detachable to said eyeglass frames.

14. A method of playing a melody, comprising the steps of:

providing a sound generating assembly capable of playing a progression of notes from a predetermined melody;

providing a sensor capable of detecting movement;

causing the sound generating assembly to play a subsequent note from said progression of notes of said predetermined melody each time the sensor detects movement; and attaching the sound generating assembly and the sensor to a person's body by embodying said sensor and said sound generating assembly in a set of eyeglass frames and placing the eyeglass frames on the head of a person.

15. The method according to claim 14, further including the step of selecting said melody from a plurality of melodies.

* * * * *